US005261763A

United States Patent [19]

Crowell

[11] Patent Number: 5,261,763

[45] Date of Patent: Nov. 16, 1993

[54] TAMPING TOOL

[76] Inventor: James E. Crowell, 97 Juniper Dr., Atherton, Calif. 94026

[21] Appl. No.: 813,202

[22] Filed: Dec. 23, 1991

[51] Int. Cl.[5] ..... E01B 27/00

[52] U.S. Cl. ..... 404/133.05; 104/10

[58] Field of Search ..... 404/133.05, 133.2; 104/10, 11

[56] References Cited

U.S. PATENT DOCUMENTS

| | | | |
|---|---|---|---|
| 3,971,323 | 7/1976 | Beiswenger | 104/10 |
| 4,068,594 | 1/1978 | Crowell | 104/10 |
| 4,606,275 | 8/1986 | Grant | 104/10 |
| 4,848,240 | 7/1989 | Johansson et al. | 104/10 |
| 4,903,609 | 2/1990 | Isakou et al. | 104/10 |
| 4,996,925 | 3/1991 | Biemann | 104/10 |

*Primary Examiner*—William P. Neuder

*Attorney, Agent, or Firm*—Flehr, Hohbach, Test, Albritton & Herbert

[57] ABSTRACT

A tamping tool comprising a shank having at its lower end a paddle of hardened steel construction, such paddle having a front face, and one or more bits of abrasion resistant material secured to the front, exposed face of the paddle and terminating at its or their lower end or ends in a ledge which underlies the lower end of the paddle. Exposed faces of the paddle and adjacent parts of the shank are covered by abrasion resistant material.

3 Claims, 8 Drawing Sheets

TAMPING TOOL

This invention relates to a tamping tool to be used for tamping ballast on railway lines and for other similar purposes, for example, crushing minerals.

In Kruse U.S. Pat. No. 3,581,664 a tool is described which is of the type with which this invention is concerned. It comprises a shank, a number of which are attached to a frame on flanged wheels which travel along the rails of a railroad and to each of which is attached a paddle which is made of hardened material such as tool steel.

Such tools have been provided at their lower edges with a harder material such as tungsten carbide which is extremely abrasion resistant. However, the steel paddle in which the carbide bits are mounted undergoes abrasion and undercutting such that the carbide bits fall out.

It is an object of the present invention to provide a tamping tool of the general character described above and in U.S. Pat. No. 3,581,664 which overcomes or diminishes these and other difficulties.

Certain embodiments of the invention are illustrated by way of example in the accompanying drawings in which.

Figure 1:
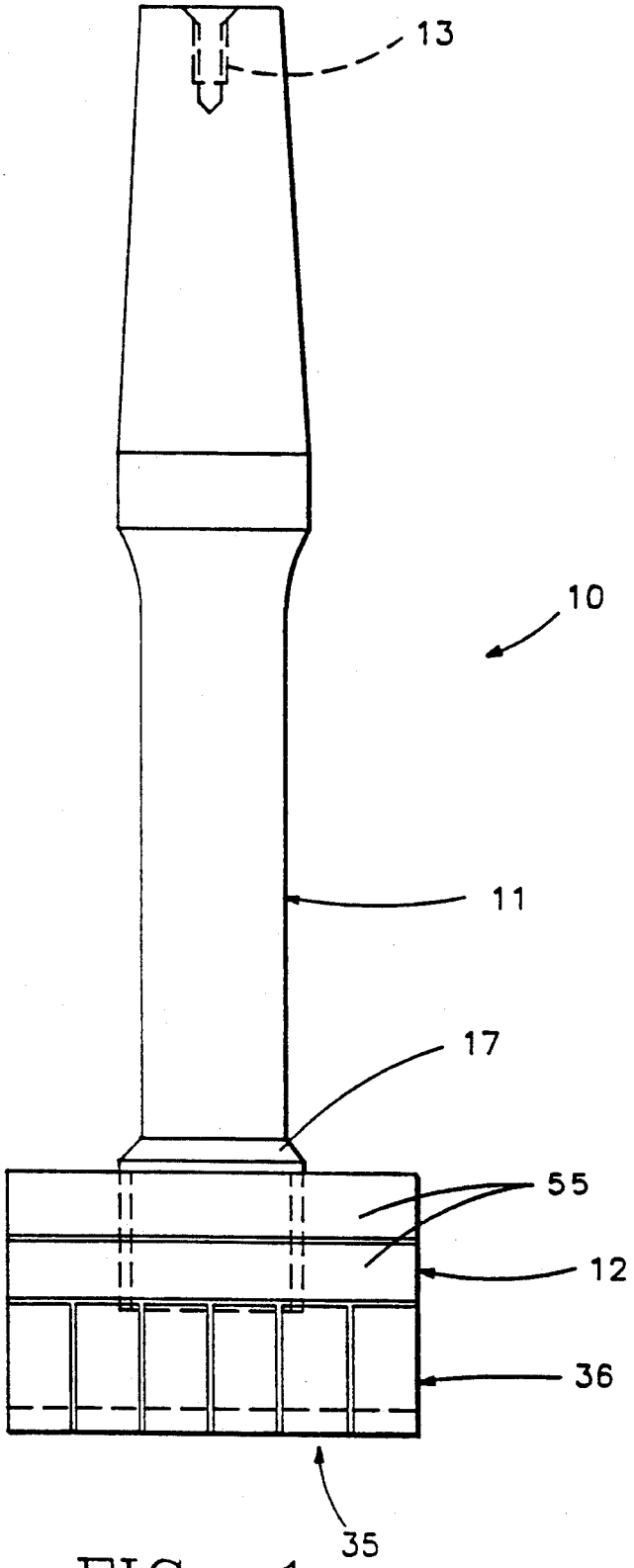
FIG. 1 is a view in front elevation of a tool including a shank, a paddle and wear bits.
Figure 2:
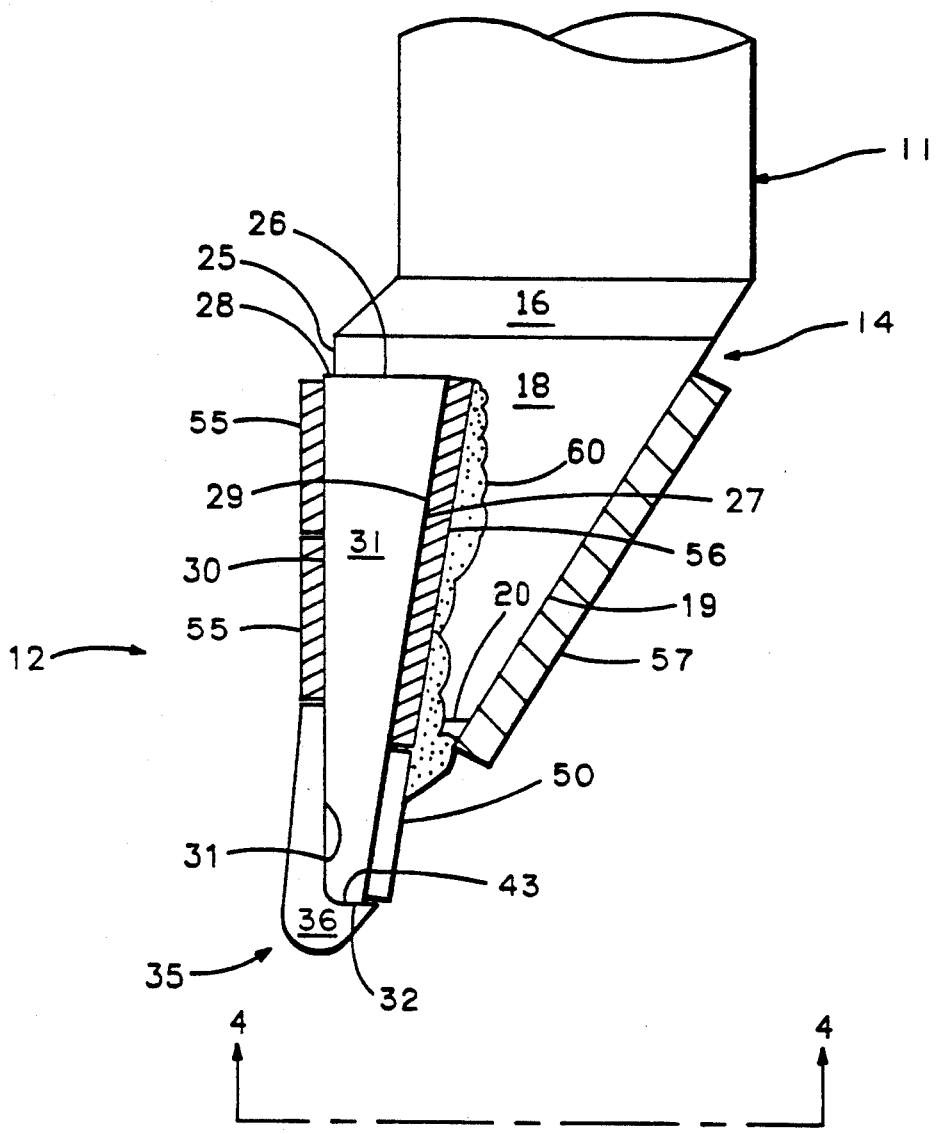
FIG. 2 is a side elevation of the same tool shown on a larger scale and with the upper part of the shank omitted.
Figure 3:
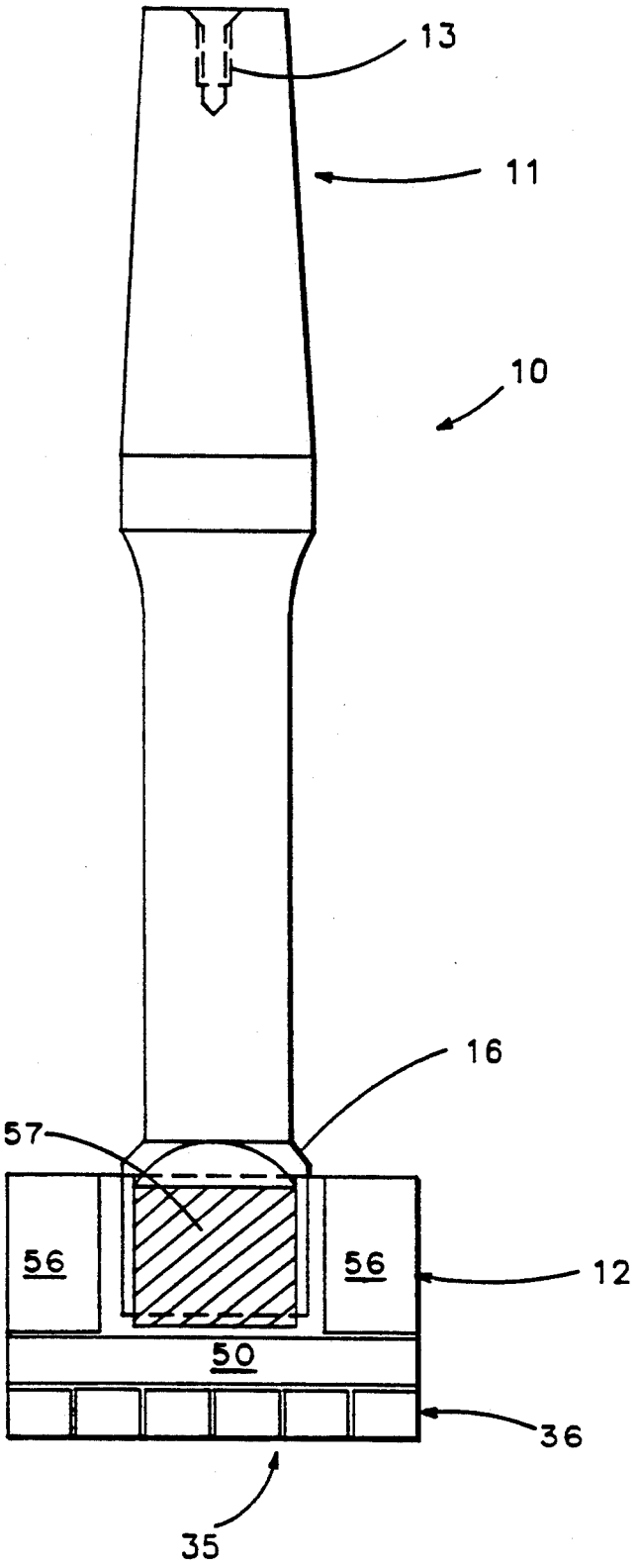
FIG. 3 is a rear view of the same tool.
Figure 4:
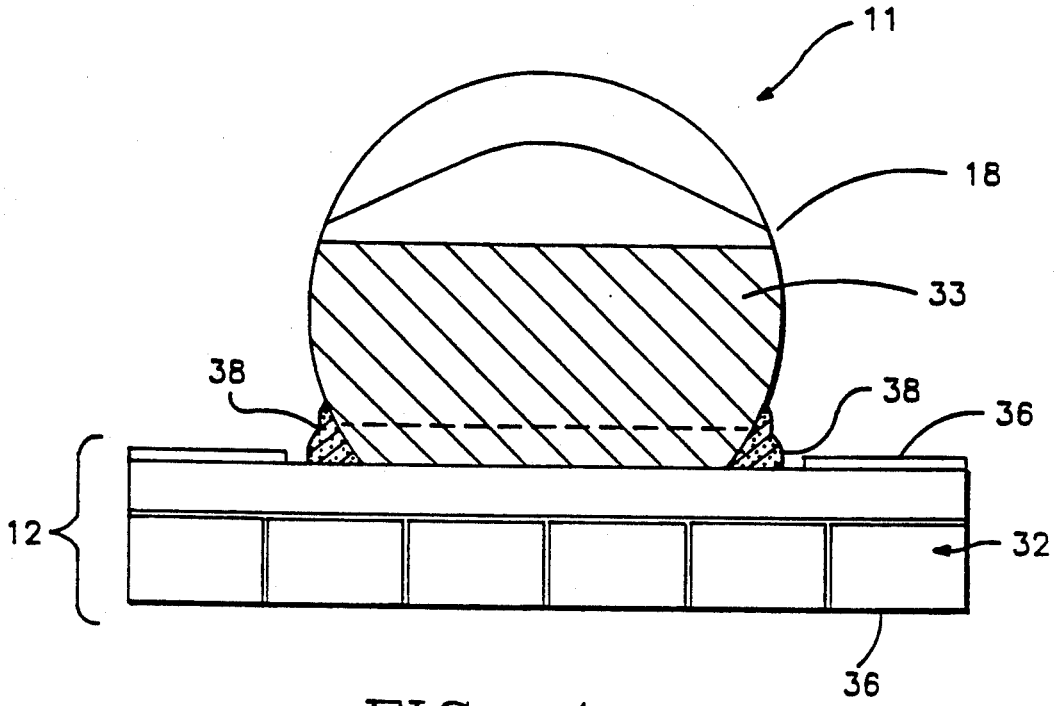
FIG. 4 is an end view along the line 4—4 of FIG. 2.

Referring now to FIGS. 1, 2 and 3, the tool in its entirety is designated by the reference numeral 10 and it comprises a shank 11 and a paddle 12 fixed to the lower end of the shank. The upper end of the shank 11 may be tapped at 13 to receive a screw or bolt by which it may be fastened to a tamping machine such as that described in U.S. Pat. No. 3,581,664 or holes may be drilled through the upper end of the shank to bolt it to a tool holder in some manner or means.

The lower end 14 of the shank onto which the paddle 12 is fixed has outwardly flaring, downwardly sloping shoulders at 16 and 17 and has a downwardly tapering portion 18 presenting a slanting face 19 terminating in a tip 20. The lower end 14 also has a flange portion 25 projecting outwardly and forming a horizontal abutment surface 26 which together with a nearly vertical abutment surface 27 forms a recess in which the paddle 12 fits.

The paddle 12 has an upper horizontal surface 28 abutting surface 26, an inner surface 29 abutting surface 27, an outer surface 30, and two lateral surfaces 31 (one of which is shown in FIG. 2). The paddle 12 is wedge-shaped, tapering in width from top to its tip 32, which is rounded.

Paddle 12 may be formed of carbon steel of suitable hardness, for example, AISI/1010 through 1040 or an alloy steel such as ASI/8620 or AISI/4130. Typically the paddle 12 is about $4\frac{1}{2}$ to $5\frac{1}{2}$ inches long, about 3 inches wide, and about $\frac{7}{8}$ to $\frac{1}{2}$ inches thick at the top and about 7/32 inch thick at the tip 32.

An important feature of the invention is a tip 35 made of wear-resistant tungsten carbide inserts or bits 36 arranged side by side as shown in FIGS. 1 and 3 and secured to the paddle 12 by brazing or other suitable means.

Figure 5:
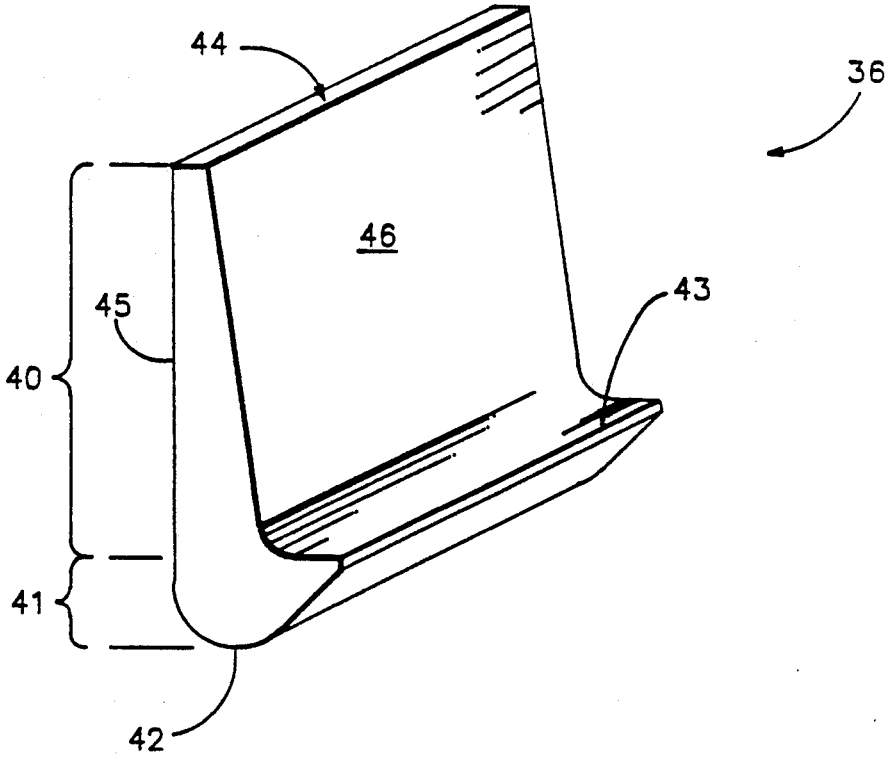
FIG. 5 is a perspective view of a wear bit or insert of the invention.

Referring now to FIGS. 2 and 5, the bit 36 is made of hard wear resistant material such as tungsten carbide which is suited for direct impact on stone, gravel or other hard mineral material. Referring more particularly to FIG. 5 the bit 36 has an upper portion 40 and a lower portion 41 terminating in a rounded tip 42. A horizontal ledge 43 provides the principal load carrying portion of the bit. The upper portion 40 has a vertical outer (exposed) surface 45 and an inner face 46 which slants as shown in FIG. 5 so as to lie flat against the outer surface 30 of the paddle 12.

The ledge 43, as shown in FIG. 2, abuts and overlies the tip 32 of the paddle 12. It also overlies at least a portion of the lower edge of a tungsten carbide strip 50 (see also FIG. 3) secured to the lower end of the face 29 of paddle 12, for example by brazing. This encapsulates the lower end of the paddle in highly abrasion resistant material such as tungsten carbide. Heretofore the primary mode of failure of carbide tipped tamping tools has been undercutting of the steel to which the tips 36 are attached, which allows the tips to drop off of the paddle. By encasing the lower end of the paddle with the bits 36 and the strip 50 this is prevented.

Exposed areas of the paddle 12 and of the lower end 14 of shank 11 which come into contact with gravel or other hard material are protected by applying wear surfaces such as those shown at 55 in FIGS. 1 and 2, at 56 in FIGS. 2 and 3 and at 57, also in FIGS. 2 and 3. These wear surfaces may be preformed plates of hard wear resistant material such as tungsten carbide or hardened steel which are secured to the shank and paddle by welding, brazing, an epoxy resin or other suitable means or by spraying granules of tungsten carbide onto the surfaces, for example, by a technique known as plasma transferred arc which is described by Gilbert A. Saltzman in an article entitled "Carbides Add Muscle to PTA Antiwear Coatings" in the February, 1986 issue of Metal Progress, at pages 25–30, which also describes a tungsten carbide alloy suitable for the purpose of the present invention. Alternatively, friction surfacing may be used as described by Wayne Thomas and Dave Nichols in an article entitled "Friction Surfacing—An Update" in the May/June, 1990 issue of Welding Institute Bulletin, R390/5/90, on pages 48 and 49.

The paddle may be secured to the shank by welding as shown at 60 in FIG. 2, or by any other suitable means.

Figure 6A:
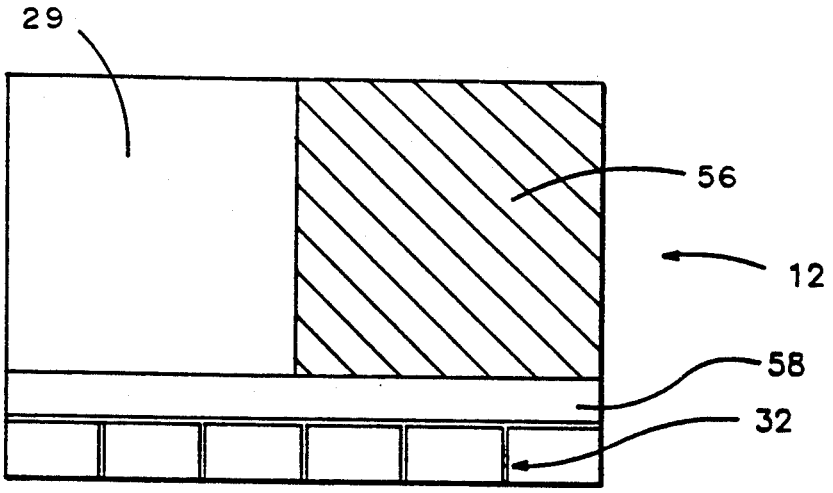
FIG. 6A is a rear view of the paddle detached from the shank showing a right hand orientation of the paddle.
Figure 6B:
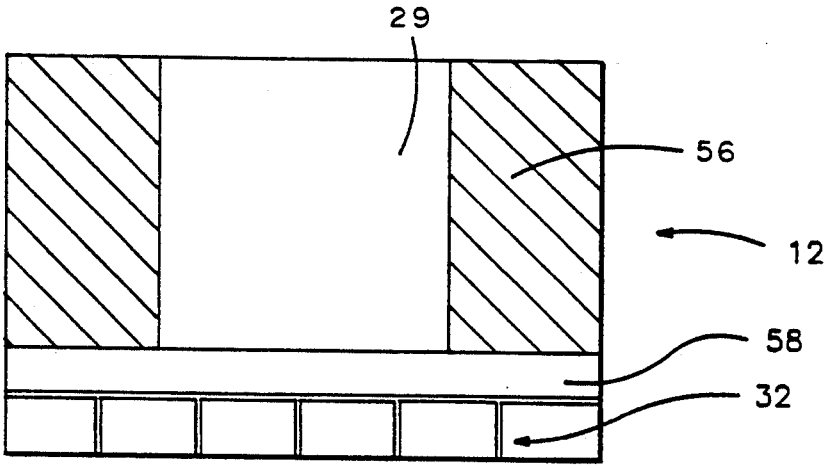
FIGS. 6B and 6C are views similar to 6A but showing a centered paddle and a left hand paddle, respectively.
Figure 6C:
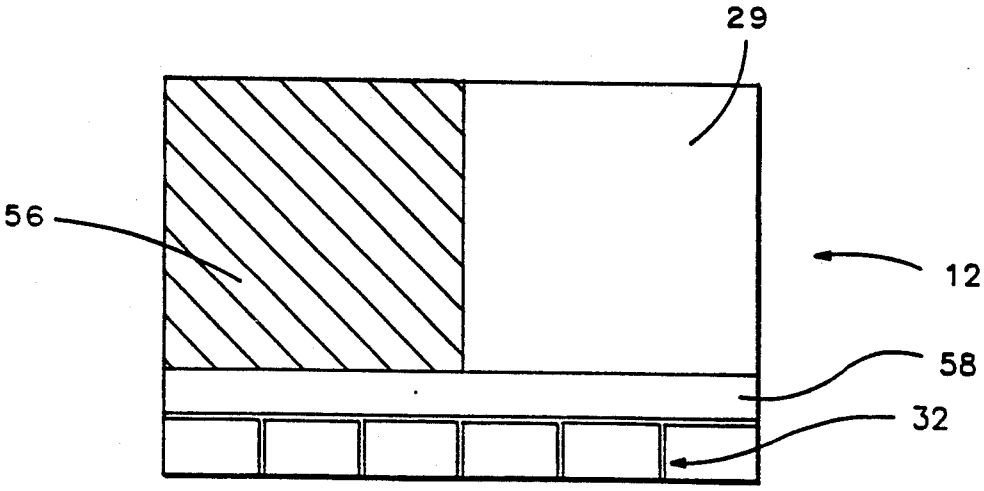

FIGS. 6A, 6B and 6C show, respectively, a right hand paddle, a centered paddle and a left hand paddle. The cross hatched areas at the rear of the paddle are provided with the protective coating 56.

Figure 7:
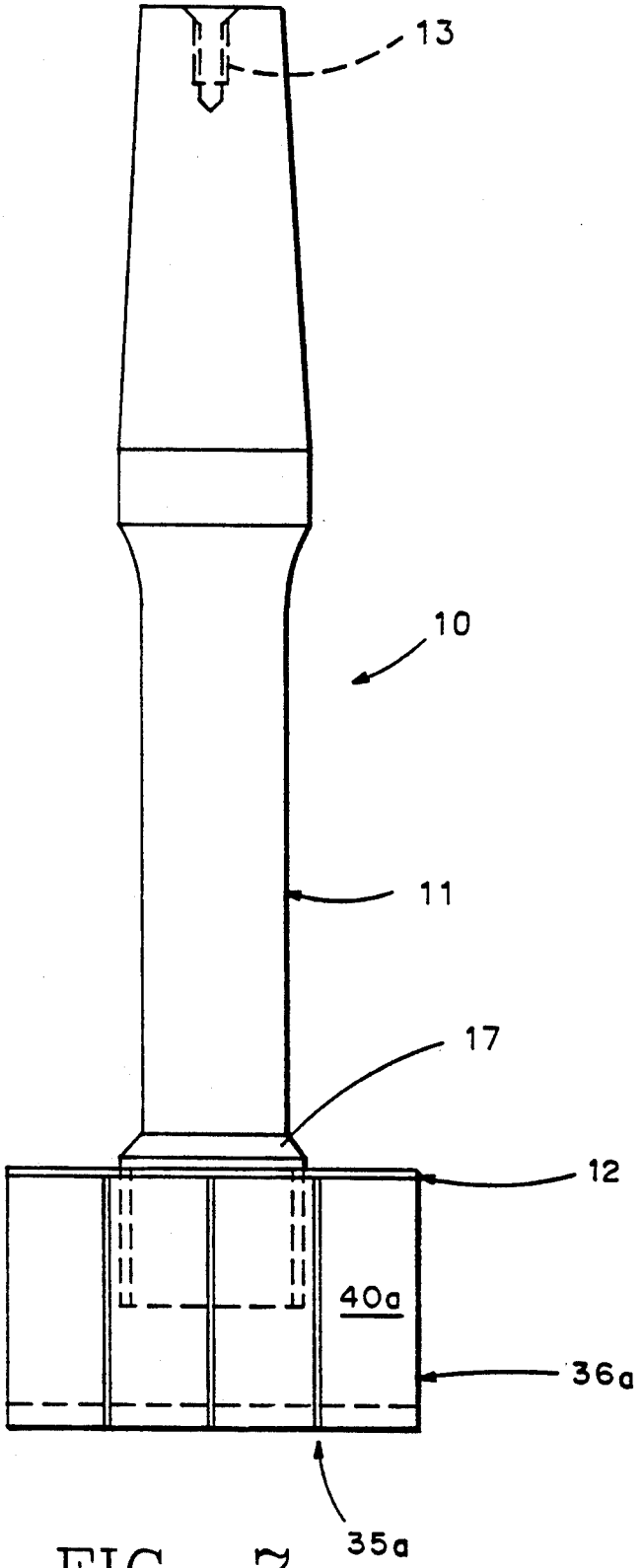
FIG. 7 is a view like that of FIG. 1 but of an alternative construction.
Figure 8:
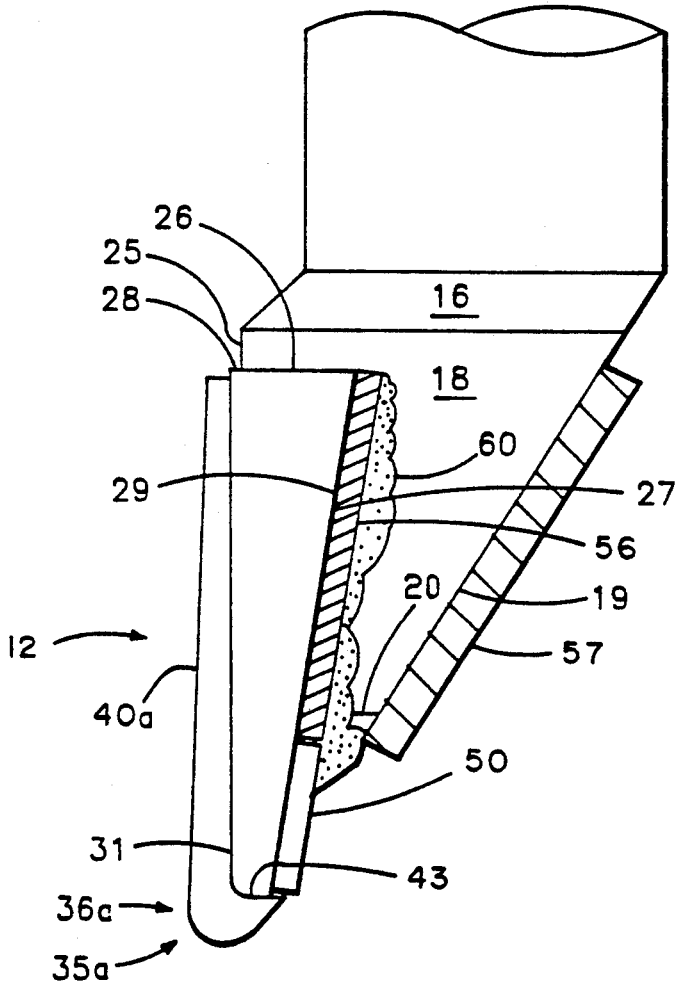
FIG. 8 is a side elevation of the tool of FIG. 7 shown on a larger scale.

Referring now to FIGS. 7 and 8, another embodiment of the invention is shown in which parts similar to those in FIGS. 1 and 2 are similarly numbered. The construction is identical to that of FIGS. 1 and 2 except that the bits 36, numbered 36*a* in FIGS. 7 and 8, are elongated, having upper portions 40*a* which extend along the entire outer face 30 of the paddle 12, thus dispensing with the need for plates 55 shown in FIG. 1.

Figure 9:
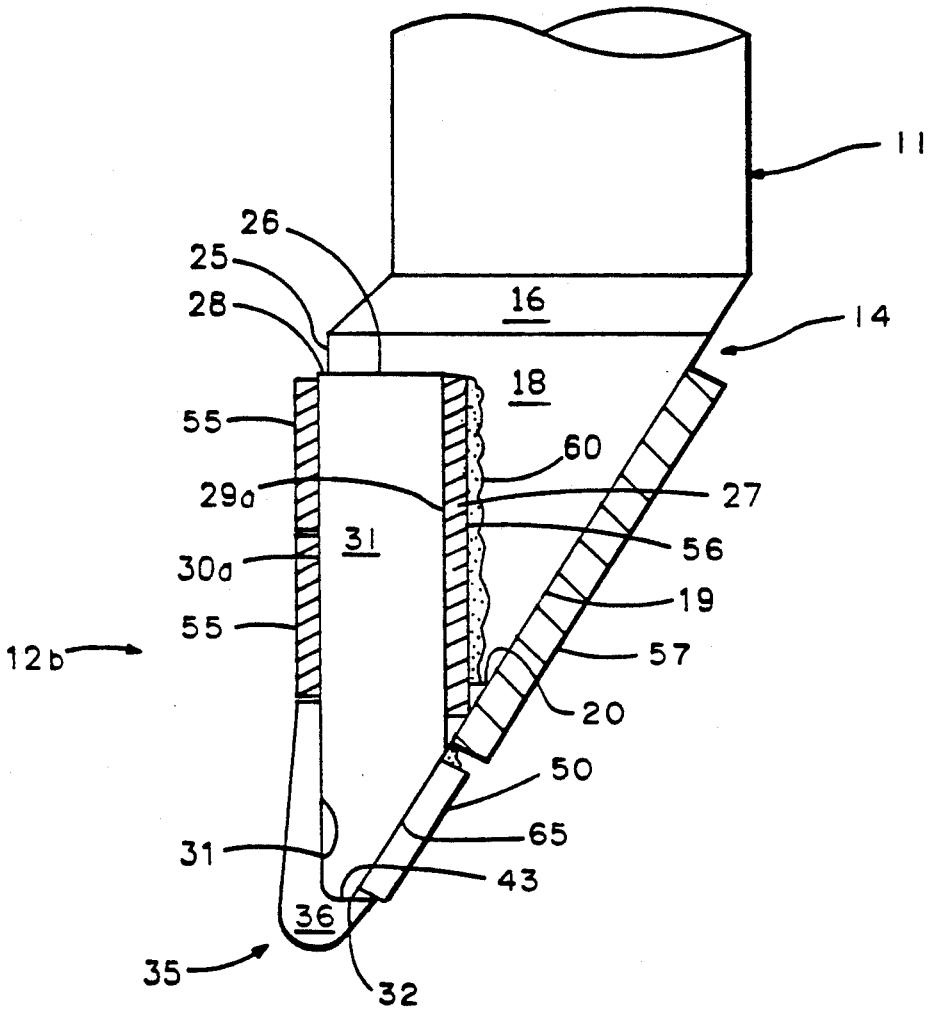
FIG. 9 is a view like that in FIG. 8 but of another construction.

Referring now to FIG. 9, another embodiment of the invention is shown in which parts similar to those in FIGS. 1 and 2 are similarly numbered. In this embodiment the paddle 12*b* has an inner surface 29*a* which is parallel to the outer surface 30*a* and the lower part 14 of shank 11 is vertical rather than slanting as in FIG. 2. Below the tip 20 of shank 14 the paddle 12*b* slants at 65 to tip 32. Typically the paddle 12*b* is about 2 inches long from upper surface 28 to the junction of surfaces 29*a* and 65.

It will thus be apparent that a new and useful tamping tool has been provided.

I claim:

1. A tool for tamping or crushing mineral material which comprises:

(a) a shank having an upper end attachable to a machine for moving the shank up and down and squeezing it in and out of particulate mineral material, said shank having a lower end including a front face and rear face, (b) a paddle of steel construction having a front face, a rear face secured to the front face of the shank and which tapers downwardly to a tip, (c) one or more bits of hard, abrasion resistant material each having an upper end and a lower end and an inner face secured to the front face of the paddle, each said bit having a body portion which overlies at least a substantial portion of the front face of the paddle and a ledge at its lower end which overlies and abuts the tip of the paddle, and (d) the exposed portion or portions of the rear face of the paddle being covered with an abrasion resistant material and said ledge projecting beyond the tip of the paddle so as to overlie the lower extremity of said abrasion resistant material.

2. The tool of claim 1 in which substantially all of the exposed surfaces of the paddle which are not covered by said bit or bits and the exposed lower end of the shank are covered by hard wear resistant material.

3. The tool of claim 1 or claim 2 in which the body portion or portions of the bit or bits cover substantially all of the front face of the paddle.

* * * * *